US012501945B2

(12) United States Patent
Herschlag

(10) Patent No.: US 12,501,945 B2
(45) Date of Patent: Dec. 23, 2025

(54) UNDERGARMENT DESIGNED TO HOLD PENIS IN VERTICAL ORIENTATION

(71) Applicant: Eric Jonathan Herschlag, Danbury, CT (US)

(72) Inventor: Eric Jonathan Herschlag, Danbury, CT (US)

( * ) Notice: Subject to any disclaimer, the term of this patent is extended or adjusted under 35 U.S.C. 154(b) by 260 days.

(21) Appl. No.: 17/976,828

(22) Filed: Oct. 30, 2022

(65) Prior Publication Data

US 2023/0135402 A1 May 4, 2023

Related U.S. Application Data

(60) Provisional application No. 63/275,481, filed on Nov. 4, 2021.

(51) Int. Cl.
*A41B 9/00* (2006.01)
*A41B 9/02* (2006.01)

(52) U.S. Cl.
CPC ..... *A41B 9/023* (2013.01)

(58) Field of Classification Search
CPC ..... A41B 9/02; A41B 9/023; A41B 9/00
See application file for complete search history.

(56) References Cited

U.S. PATENT DOCUMENTS 2,384,165 A * 9/1945 Goldfarb ..... A41B 9/02 2/404
2,438,310 A * 3/1948 Ashe ..... A41B 9/02 2/403
2,494,261 A * 1/1950 Owenby ..... A41B 9/02 2/404
2,519,534 A * 8/1950 Artzt ..... D04B 1/246 66/175
2,575,701 A * 11/1951 Artzt ..... A41B 9/02 2/403
2,641,257 A * 6/1953 Rutledge ..... A61F 13/72 2/403
2,641,258 A * 6/1953 Rutledge ..... A41B 9/02 450/104
2,664,889 A * 1/1954 Bailey ..... A41B 9/02 2/403
3,083,710 A * 4/1963 Rauser ..... A41B 9/02 2/404
3,088,121 A * 5/1963 Stedman ..... A41B 9/02 2/401
3,166,764 A * 1/1965 Stedman ..... A41B 9/02 2/403

(Continued)

*Primary Examiner* — Richale L Quinn
(74) *Attorney, Agent, or Firm* — Michael J. Feigin, Esq.; Feigin and Fridman LLC

(57) ABSTRACT

An undergarment which keeps a male penis in a vertical orientation, whether flaccid or erect, or changing between such states, has a medial crotch panel. The medial crotch panel has a taut upper section and more flexible and/or extendable lower region. The upper section is designed to hold a shaft of a penis while the lower region holds a scrotum thereof. In order to keep the taut state of the medial crotch panel the panel is connected to taut side panels and a waist band, which, each are taut and tight along an anterior side of a person wearing the undergarment. The crotch panel can be in an hourglass shape such that a tightest region thereof is at the narrowest portion of the crotch panel where a shaft, below the glans, is held.

8 Claims, 2 Drawing Sheets

(56) References Cited

U.S. PATENT DOCUMENTS 3,207,155 A * 9/1965 Casey ..... A41B 9/026 2/403
3,295,520 A * 1/1967 Keller ..... A41B 9/02 2/404
3,511,234 A * 5/1970 Larson ..... A41B 9/02 2/404
4,173,976 A * 11/1979 Bloomquist ..... A41B 9/02 2/403
6,557,182 B2 * 5/2003 Taylor ..... A61F 5/40 2/403
7,774,865 B2 * 8/2010 Miller ..... A41D 1/089 2/403
7,958,571 B2 * 6/2011 Kitsch ..... A41B 9/023 2/403
8,230,526 B2 * 7/2012 Holland ..... A41D 7/005 2/403
8,601,616 B2 * 12/2013 Radford ..... A41B 9/02 2/403
8,615,816 B2 * 12/2013 Harimoto ..... A41B 9/02 2/403
8,661,569 B2 * 3/2014 Baek ..... A41B 9/023 2/403
9,301,551 B2 * 4/2016 Bäck ..... A61F 13/49019
10,053,804 B2 * 8/2018 Frantz ..... D04B 1/243
10,165,801 B2 * 1/2019 Blibech ..... A41B 9/02
10,342,266 B2 * 7/2019 Oh ..... A41B 9/023
10,750,793 B1 * 8/2020 Theodoridis ..... A41B 9/001
10,986,877 B2 * 4/2021 Kimel ..... A41B 9/023
11,272,744 B2 * 3/2022 Shaughnessy ..... A41B 9/004
11,553,737 B1 * 1/2023 Hong ..... A41B 9/023
12,108,811 B2 * 10/2024 Jamieson ..... A41B 9/023
2008/0052807 A1 * 3/2008 Lai ..... A41B 9/023 2/400
2008/0178369 A1 * 7/2008 Kitsch ..... A41B 9/023 2/405
2009/0300826 A1 * 12/2009 Harimoto ..... A41B 9/02 2/403
2010/0162470 A1 * 7/2010 Kim ..... A41B 9/02 2/403
2010/0170028 A1 * 7/2010 Edwardsen ..... A41B 9/023 2/404
2012/0204325 A1 * 8/2012 Todd ..... A41B 9/02 2/403
2013/0174328 A1 * 7/2013 Rolon ..... A41B 9/023 2/403
2013/0298314 A1 * 11/2013 Feng ..... A41B 9/02 2/403
2014/0100505 A1 * 4/2014 Vargas Snyder ... A63B 71/1216 602/70
2014/0331390 A1 * 11/2014 Matsumoto ..... A41B 9/023 2/403
2015/0320118 A1 * 11/2015 Frantz ..... D04B 1/108 2/403
2018/0007975 A1 * 1/2018 Crump ..... A41B 9/001
2018/0055096 A1 * 3/2018 Chan ..... A41B 9/023
2018/0132538 A1 * 5/2018 Yan ..... A41B 9/14
2020/0060353 A1 * 2/2020 Crump ..... A41B 9/023
2020/0237020 A1 * 7/2020 McCombs ..... A41B 9/02
2020/0297040 A1 * 9/2020 Weber-Unger ..... A41B 9/02
2020/0397067 A1 * 12/2020 Yarnall ..... A41B 13/08
2023/0135402 A1 * 5/2023 Herschlag ..... A41B 9/023 2/403
2023/0240382 A1 * 8/2023 Baek ..... A41B 9/023 2/403

* cited by examiner

UNDERGARMENT DESIGNED TO HOLD PENIS IN VERTICAL ORIENTATION

FIELD OF THE DISCLOSED TECHNOLOGY

The disclosed technology relates generally to undergarments, and more specifically to an undergarment that holds a penis in a vertical orientation whether flaccid or erect.

BACKGROUND

Conventional underpants provide varying degrees of support for the shaft and scrotum (testicles). The tightest conventional support is known as a "jock strap" that firmly presses the genitals against the body enabling athletic body movement such as running or jumping while holding the genitals in a fixed position. In contradistinction, if a man runs while completely naked, the testicles will bob up and down and all around while the shaft will flop from side to side. If running while wearing loose gym shorts and no underpants, the shaft flops around repeatedly colliding with and rubbing into the shorts causing pain and sores. Running while wearing conventional briefs of elastic material will hold the genitals in place less firmly than jock strap. For men with larger than average genitals, conventional briefs do not completely prevent the genitals from colliding with and abrasing the outer shorts. As such, some prefer the more constricting jock strap.

A primary varying factor between the varying types of conventional underpants is how much constraint is used to keep the genitals in place. The average length of a flaccid penis is 3.66 inches, and an erect penis 5.16 inches. For an individual man the length when flaccid changes depending on temperature, mood, arousal, activity, and other factors. Men with longer than average flaccid state penises, as well as men who are easily and often aroused to erection are often experience distress and agitation from the constraints imposed by conventional underwear.

Men not engaged in rigorous physical activity sometimes prefer underwear 10oser than (bikini) briefs, such as boxer briefs (snug fitting from elastic material) or boxers (that are loose fitting, conventionally made from inflexible material). The preference of looser and less supporting stemming from the preference of the comfort of not being constrained.

SUMMARY OF THE DISCLOSED TECHNOLOGY

An undergarment of embodiments of the disclosed technology is designed to hold a shaft of a penis vertically. "Vertical" and "vertically" are defined as "in a direction such that the glans (of the penis) is closer to the waist than the scrotum" and/or "the glans is pointed away from the ground during ordinary use of the undergarment while the wearer is in an standing position" and/or "such that the shaft is substantially completely, or completely, against a torso of the body". For purposes of this disclosure the "torso" is defined as "an anterior side of a body between the arms and legs which includes and extends to the perineal region and/or a region between the legs." A penis placed within the medial partially slacked crotch panel remains in the vertical orientation even when the penis changes from a flaccid to an erect state and from an erect to a flaccid state.

The undergarment, in embodiments, has a waistband, side panels, a crotch panel, and leg openings. The waistband is fixedly connected to the side panels, the rear panel, leg panels (with leg openings), and the crotch panel in embodiments. The side panels are taut (adapted or designed to be held against a wearer sometimes in a stretched condition). The entirety of the undergarment, in some embodiments, is made of elastic material and/or taut. The crotch panel can have a taut region and slacked region. The terms "taut" and "slacked" can be used relative to each other. Alternatively or additionally "taut" can be defined as "being stretched relative to a resting position into a flat or curviflat shape". "Curviflat" is defined as "flat along a curved plane." "Slacked" is defined as "loose during a resting condition" and/or "designed to stretch while in a current condition, at least partially folded." It should be understood that each of the terms used in this paragraph are defined as being exactly as defined, within an acceptable tolerance level known in the undergarment industry, and/or substantially as defined.

The side panels can be entirely taut and fixedly attached to the crotch panel, the crotch panel being medial relative to the side panels and/or centered on a front side of the undergarment. The crotch panel can be partially slacked (such as at a lower region thereof/a region adapted for placement of a scrotum of a penis) and partially taut (such as at an upper side thereof/a region adapted for placement of the glans and at least a part of the urethra). Two leg openings are each lateral and connected to an adjacent taut side panel of the two taut side panels.

Said another way, the medial partially slacked crotch panel is taut at a superior side thereof and slacked at an inferior side thereof. The "superior side" and "inferior side" are relative to one another along a vertical plane. The "superior side" is also referred to as the "upper side" and the "inferior side" is also referred to as the "lower side" in embodiments of the disclosed technology. Each of these upper and lower sides is not less than 25% of the overall vertical length and/or longest linear or curviflat or curvilinear length of the crotch panel. The medial partially slacked crotch panel is hourglass shaped along a vertical axis in some embodiments such that the superior and inferior regions of the crotch panel are wider than a portion thereof which is between the superior and inferior regions (a middle region). The portion which is narrower in the crotch panel can be a portion which in a middle third of vertical extent of the crotch panel and excludes the inferior and superior regions of the crotch panel.

The taut portion of The medial partially slacked crotch panel has an anterior range of motion of 3 centimeters, in an embodiment of the disclosed technology. The anterior range of motion (a maximum distance the taut portion of the crotch panel can move away from a torso of a wearer) can be 1, 2, 3, or 4 centimeters and selected based on a circumference and/or width of a shaft of a penis of a wearer of the undergarment in one of a resting or aroused state. The anterior range of motion, in some embodiments, is while the two side panels are stretched flat (or curviflat) over a wearer and further, in some embodiments, the taut portion of the medial partially slacked crotch panel is held taut.

In some embodiments of the disclosed technology a narrowest region of the medial partially slacked crotch panel (an inner or middle region of the "hourglass" described above) is located where a shaft of the penis is placed when a scrotum of the penis is within an inferior region of the medial partially slacked crotch panel. The scrotum region of the crotch panel is slacked relative to a rest of the undergarment in embodiments of the disclosed technology. As such, an entirety of the undergarment can be adapted and/or fitted and/or designed to snugly hold against a wearer of the undergarment but for/excluding at least a portion of the medial crotch panel. This excluded portion is an inferior region of the crotch panel.

A rear panel is fixedly attached, in embodiments of the disclosed technology, to each of the two taut side panels, the medial partially slacked crotch panel, and each of two leg panels each having respective leg opening.

Described another way, in embodiments of the disclosed technology, a posterior panel with curved lateral sides extends into a narrow perineal section. A crotch panel is fixedly connected, at a lower end, to the perineal section of the posterior panel. An upper end of the crotch panel, at an end opposite the lower end of the crotch panel, is fixedly attached to a waist portion of the undergarment (a part of the undergarment designed for/adapted to surround a waist of a wearer). Two side panels, each with a lateral edge fixedly connected to a leg panel and a medial edge fixedly attached to the crotch panel, is attached to the waist portion by way of an upper edge. The crotch panel has slack at an lower end thereof when the two side panels and the posterior panel are stretched away from the crotch panel.

In some embodiments the lateral edge of each of the two side panels has two linear portions thereof joined at an acute angle. The medial edge of each of the two side panels is curvilinear and the upper edge of each of the two side panels are linear in embodiments. An upper end of the crotch panel lacks slack when the two side panels and the posterior panel are stretched away from the crotch panel. Further, the undergarment can be adapted such that a shaft of a penis is held upwards when placed between a torso and the crotch panel in a starting position pointed as such. This can be in both a relaxed (non-aroused) and in an aroused state, as well as when the penis changes between such states.

A scrotum can be loosely held within the undergarment when the shaft of the penis is placed in the crotch panel. "Loosely" is defined as "movably relative to a body of a wearer and non-taut".

The orientations used in embodiments of the disclosure technology are described with reference to the undergarments being worn on a healthy standing erect male human. "Anterior" refers to a front side of the person. "Posterior" refers to the rear side. "Superior" is "higher" (towards the head of a person) than an "inferior" side which is "lower" (towards the feet). "Lateral" refers to a more outer part of the body compared to "medial" which is more towards the middle of the body along a horizontal place. The "medial" crotch panel is at the center (along a horizontal plane) of the undergarment and/or person wearing the undergarment. The undergarment, in embodiments of the disclosed technology, has a vertical plane of symmetry, or substantially a vertical plane of symmetry, at a center line (most medial line) of the undergarment.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

An undergarment which keeps a male penis in a vertical orientation, whether flaccid or erect, or changing between such states, has a medial crotch panel. The medial crotch panel has a taut upper section and more flexible and/or extendable lower region. The upper section is designed to hold a shaft of a penis while the lower region holds a scrotum thereof. In order to keep the taut state of the medial crotch panel the panel is connected to taut side panels and a waist band, which, each are taut and tight along an anterior side of a person wearing the undergarment. The crotch panel can be in an hourglass shape such that a tightest region thereof is at the narrowest portion of the crotch panel where a shaft, below the glans, is held.

Figure 1:
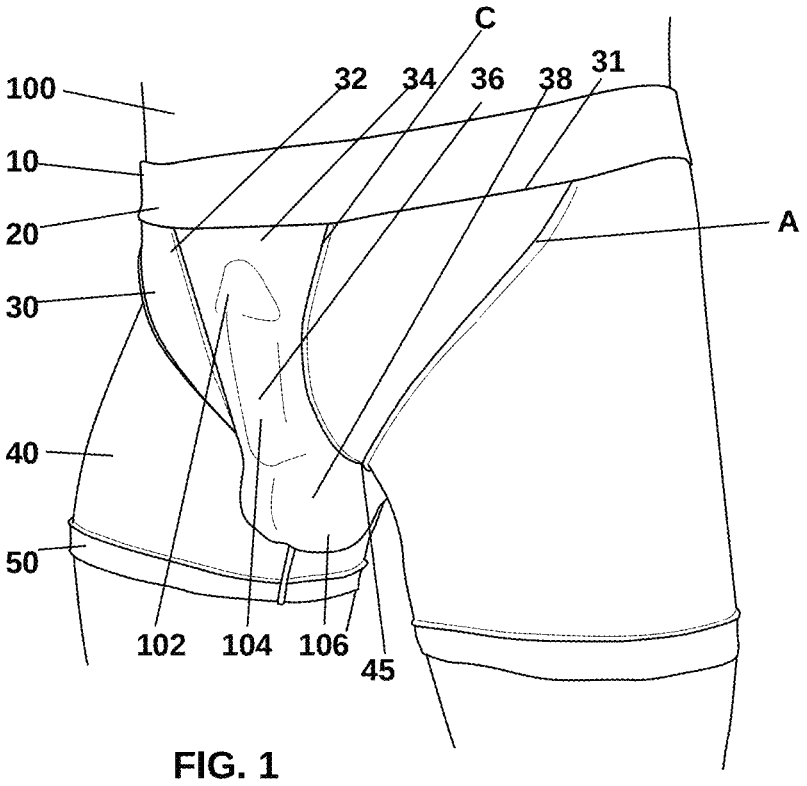
FIG. 1 shows a perspective view of an undergarment with medial crotch panel being worn in an embodiment of the disclosed technology.

FIG. 1 shows a perspective view of an undergarment with medial crotch panel being worn in an embodiment of the disclosed technology. The undergarment 10 is worn by a male 100 with penis, the penis having a glans 102, shaft 104, and scrotum 106. The penis 102/104/106 is within a medial crotch pane 34 herein referred to as a "crotch panel" or medial partially slacked crotch panel". The crotch panel 34 is part of a "vertically middle" section of the undergarment which further comprises taut side panels 30, two leg panels 40, and a posterior panel 44. A waistband 20 forms a vertically upper section of the undergarment 10 to which the crotch panel 34, side panels 30, leg panels 40 and posterior (or rear) panel 44 are each fixedly attached, such as via stitching.

"Fixed" or "fixedly" is defined herein as "designed to remain connected through at least 100 wearings of the undergarment" and/or "requires cutting or destructive actions to remove."

Figure 2:
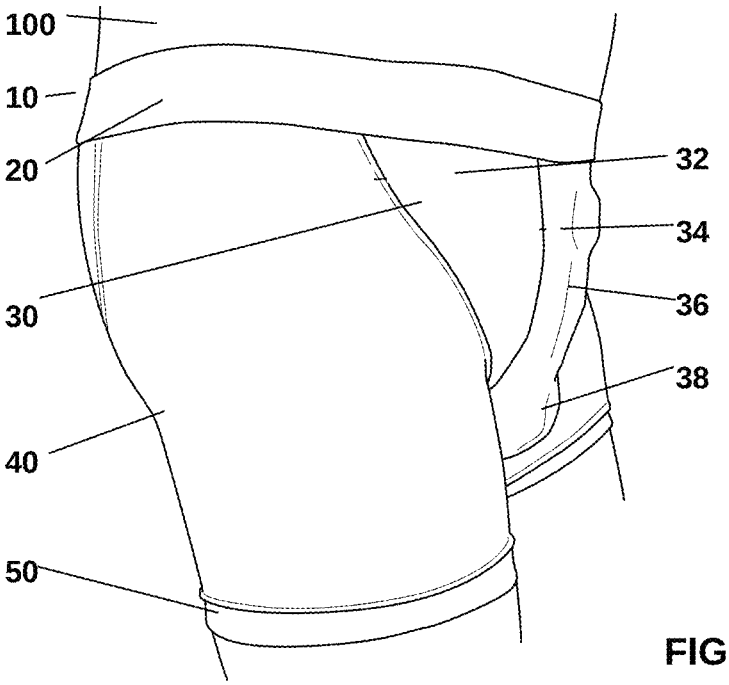
FIG. 2 shows a reverse side perspective view of the undergarment of FIG. 1 being worn.

FIG. 2 shows a reverse side perspective view of the undergarment of FIG. 1 being worn. In this Figure a leg panel 40 is more clearly visible. Note that the two leg panels are substantially identical or identical in embodiments of the disclosed technology. The undergarment can have a vertical line of symmetry extending equi-distant between the legal panels 40 and/or at a vertical medial line and/or at a center of the crotch panel 34.

The compression fabric is elastic, stretching in all four directions. Each of the seams between panels have thin (0.8 mm) elastic bands sewn into the seams. The function of the "compression-fabric" and its design and shape is to tightly hold the shaft in place. This function is enhanced with the thin elastic bands being sewn into the seams that adjoin the panels; these thin elastic bands only stretch in the linear path of the band, with each end of these thin bands being anchored to the thick waistband; one end attaching to the rear of the waistband, and the other end attaching to the front of the waistband. The design and placement of the seams with elastic bands follows the contour of the human form in such a way as to enhance the function of the garment of holding the shaft in place.

Seams with elastic bands include seams between panels 40 and 32, 32 and 40, 30 and 40, 44 and 40. The pull of these elastic bands sewn into the seams further creates tension along the base of the shaft by placing tension towards the midline of the body without constriction of the testicles, due to the positioning and elastic nature of the seams between the panels 32 and 34.

Further, note that side panel 32 is taut meaning that the panel is held in the entirety, or substantially in the entirety, against the skin of wearer and/or stretched substantially to a maximum. So too, the leg panels 40 are stretched as such, and against a skin of a wearer in such a manner, from an anterior side thereof to at least a beginning of a posterior side thereof and/or to a beginning of a fixed connection with the rear panel 44.

Reviewing the above, the undergarment 10 has a top region 20 with elastic band or other mechanism holding the top region to a torso of a wearer (at a front and back side thereof). Beneath the top region 20 is a mid-region 30 with a centrally placed crotch panel 34 surrounded on two sides by front panels 30. The crotch panel has a taut region 34 and slacked or loose region 38, compared to the taut region. "Taut" can further be defined as "when pulled between two fingers and released, snaps back into a resting condition before the pulling." The entirety of the mid-region is held taut in embodiments of the disclosed technology based on a pull of the leg panels 40 on the front panels 32 which pull on the crotch panel 36 and a rear panel 44.

Figure 4:
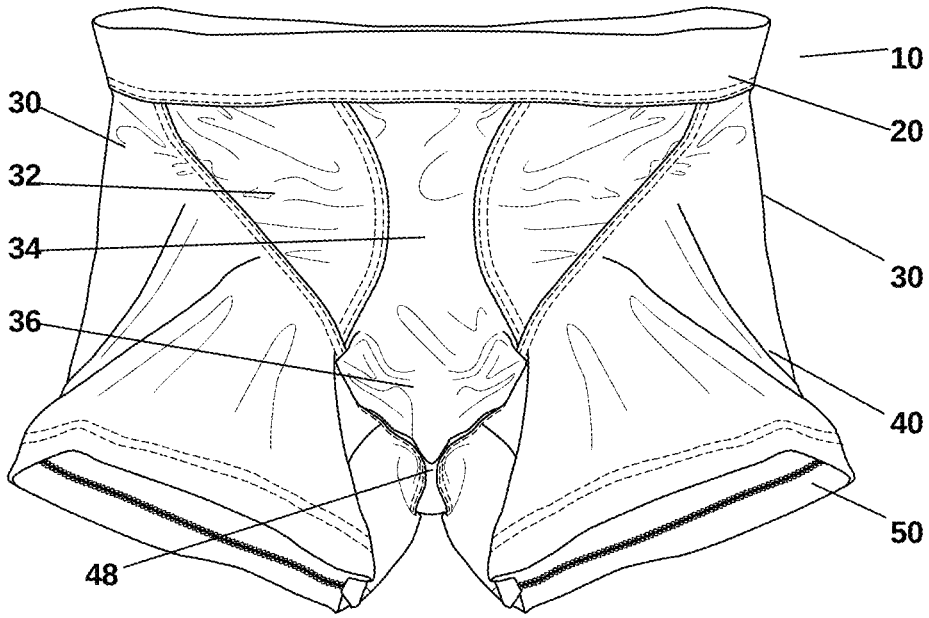
FIG. 4 shows a front elevation view of the undergarment of FIG. 1.

Describing out of order, FIG. 4 shows a front elevation view of the undergarment of FIG. 1. The crotch panel 34 has a narrower/narrowest portion on the anterior (front) side situated between a superior (top) and inferior (bottom) region thereof. The crotch panel 34 is thus an hourglass shape when viewing the front side thereof. "Hourglass" is defined as "having wider ends than a central portion between the two ends." The narrowest region (@ label 34 in FIG. 4) holds the shaft of the penis 104 (see FIG. 1) while a superior (top) region of the crotch panel 34 holds the glans 102 of the penis. The scrotum 106 is in a lower region 36 of the crotch panel 34.

The perineal section 48 of the crotch panel, in some embodiments of the disclosed technology, is integrated as part of the crotch panel 34. "Perineal" is defined as "the area extending from the anus to the scrotum." The "perineal section" is a majority, substantially all, and/or all of the "perineal". In this non-worn/resting configuration of the undergarment 10 while not on a person one can see that the front panels 32 are taut, though less taught than the upper part of the crotch panel 34 and more taut than a lower side/part 36 of the crotch panel 34. This is so that there is room for the scrotum 106 to hang therein without the fabric being taut thereon. When the undergarment 10 is worn on a person of a proper size (e.g. having a waist substantially equal to the circumference of a taut waistband 20) then the side panels 32, leg panels 40, and crotch panel 34 become more taut (more tight/more stretched).

Figure 3:
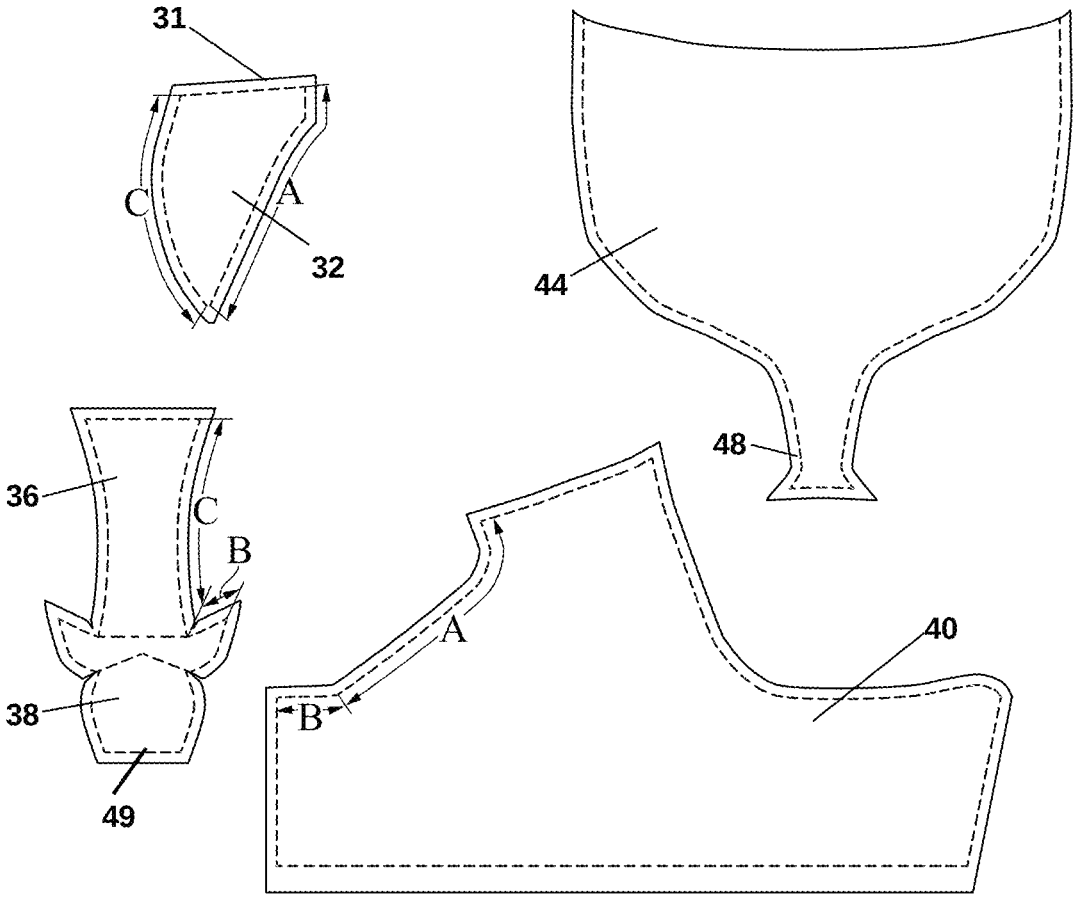
FIG. 3 shows a plan view of panels used to create the undergarment of FIG. 1.

Returning now to FIG. 3, FIG. 3 shows a plan view of panels used to create the undergarment of FIG. 1. The side panel 32, two of which are used to form the undergarment 10, has a convex curvilinear side at letter C. A linear/flat side 31 is between the letters A and C and forms a top (superior) side of the panel in the undergarment 10. Another side, at letter A, has two linear parts with an acute angle between the linear parts, the inferior part being longer than the superior part. Described differently, a side panel 32 has a perimeter comprising a substantially linear first side 31, and second side A, and an obtusely oriented curvilinear side C. While in the embodiment of FIG. 3, side A is shown to comprise multiple linear segments, in alternative embodiments (such as that of FIG. 1), side A is substantially linear comprising a single linear segment. This side panel attached to a leg panel 40 whereby the portions thereof labeled with letter A are sewn or otherwise fixedly connected to one another. There are two leg panels 40; one for each leg. As further shown in FIG. 1, side A and side C are adjoined at an intersection 45 of a the leg panel 40 and the crotch panel 34.

The crotch panel has a shaft region 36, scrotum region 38, and perineal region 49. Each of these regions is adapted/designed/configured to cover the region of a person for which it is named. The shaft region 36 of the crotch panel 34 has two concave curvilinear sides which form the hourglass shape. Each of these concave curvilinear sides has a side C which attached to an oppositely-angled convex curvilinear side C of a side panel 32. This side panels 32 are stretched in a curve into the page (along a Z-axis) as well as an X-axis forming a rounded front of the undergarment along with the upper part 36 of the crotch panel and the rear panel 44.

The crotch panel has, in embodiments of the disclosed technology, has two wings labeled at B which fold and attach to the leg panel at B. This then creates a perineal region 49 of the crotch panel which at a linear end thereof is fixedly attached to a perineal region of the rear panel 44, the rear panel adapted to cover the glutes/gluteal muscles. This, when worn, causes the crotch panel to be pulled in an inferior direction (down) while one or both of the rear panel 44 and crotch panel 49 pass over the perineal section of a person wearing the undergarment 10.

As such, the crotch panel 34 is stretched and held taut when worn by a perineal region 49 thereof pulling on a loosely configured scrotum region 38. The crotch panel 34 is further stretched and held taut at an upper side by a waistband 10 and at lateral sides by side panels 32, and in some embodiments, leg panels 40.

For Purposes of this Disclosure, the Term "Substantially" is Defined as "at Least 95% Of" the Term which it Modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein-above are also contemplated and within the scope of the invention.

The invention claimed is:

1. An undergarment designed to hold a shaft of a penis vertically comprising:

a waistband;

two taut side panels attached to a bottom side of said waistband;

a medial partially slacked crotch panel, slacked relative to said two taut side panels, attached to said waistband and between said two taut side panels, wherein said taut and said at least partially slacked are relative to one another;

two leg openings each lateral and connected to an adjacent tout side panel of said two taut side panels;

wherein said medial partially slacked crotch panel is taut at a superior side thereof compared to a looser slacked inferior side thereof, said looser slacked inferior side extending into substantially all of a perineal region of the undergarment; and further comprising a rear panel which is fixedly attached to:

each of said two taut side panels;

said medial partially slacked crotch panel; and each of two leg panels comprising a respective leg opening of said two leg openings.

2. An undergarment constructed from:

a posterior panel with curved lateral sides extending into a narrow perineal section;

a crotch panel fixedly connected, at a lower end, to said perineal section of said posterior panel;

an upper end of said crotch panel at an end opposite said lower end of said crotch panel, fixedly attached to a waist portion of said undergarment; and two side panels, wherein each side panel of said two side panels further comprises the following sides:

a substantially linear first side fixedly connected to said waist portion;

a second substantially linear side fixedly connected to a leg panel;

an obtusely oriented curvilinear side fixedly connected to said crotch panel; and said first linear side, said second linear side, and said obtusely oriented curvilinear side are fixedly attached to one another;

wherein said crotch panel has a slacked region at a lower end thereof when said two side panels and said posterior panel are stretched away from said crotch panel.

3. The undergarment of claim 2, wherein:

said first linear side and said second linear side are adjoined at an intersection of said leg panel and said waistband;

said first linear side and said obtusely oriented curvilinear side are adjoined at an intersection of said waistband and said crotch panel; and said second linear side and said obtusely oriented curvilinear side are adjoined at an intersection of said crotch panel and said leg panel.

4. The undergarment of claim 2, wherein an upper end of said crotch panel is more taut than said two side panels and said posterior panel in a resting configuration and when said waistband is stretched taut.

5. The undergarment of claim 2, wherein said undergarment has a more taut upper region of said crotch panel than a lower region of said crotch panel causing, in a worn configuration of the undergarment, a shaft of a penis held upwards when placed between a torso and said crotch panel.

6. The undergarment of claim 5, wherein said waistband is stretched taught and said crotch panel is taut against a wearer of said undergarment in a manner such that a shaft of a penis placed vertically therein remains in said vertical orientation in both of a flaccid and erect state of said penis.

7. The undergarment of claim 6, wherein said vertical orientation is maintained when said penis changes between said flaccid and said erect state.

8. An undergarment constructed from:

a posterior panel with curved lateral sides extending into a narrow perineal section;

a crotch panel fixedly connected, at a lower end, to said perineal section of said posterior panel;

an upper end of said crotch panel at an end opposite said lower end of said crotch panel, fixedly attached to a waist portion of said undergarment; and two side panels, wherein each side panel of said two side panels further comprises the following sides:

a substantially linear first side fixedly connected to said waist portion;

a second substantially linear side fixedly connected to a leg panel;

a obtusely oriented curvilinear side fixedly connected to said crotch panel; and said first linear side, said second linear side, and said obtusely oriented curvilinear side are fixedly attached to one another;

wherein said crotch panel has a slacked region at a lower end thereof including at a at least most of a perineal section thereof, said perineal section corresponding to an anus and scrotum of said undergarment.

* * * * *